US009784426B2

(12) United States Patent
Holder

(10) Patent No.: US 9,784,426 B2
(45) Date of Patent: Oct. 10, 2017

(54) SYSTEMS AND METHODS FOR FORMING SELF-SUPPORTING THREE-DIMENSIONAL STRUCTURES

(71) Applicant: Roly Joe Holder, Austin, TX (US)

(72) Inventor: Roly Joe Holder, Austin, TX (US)

( * ) Notice: Subject to any disclaimer, the term of this patent is extended or adjusted under 35 U.S.C. 154(b) by 302 days.

(21) Appl. No.: 14/445,877

(22) Filed: Jul. 29, 2014

(65) Prior Publication Data

US 2016/0031592 A1 Feb. 4, 2016

(51) Int. Cl.
*F21V 1/12* (2006.01)

(52) U.S. Cl.
CPC ..... *F21V 1/12* (2013.01)

(58) Field of Classification Search
CPC ..... A63H 33/06; A63H 33/062; A63H 33/08; G09B 19/10; G09B 23/04; F21V 1/12
See application file for complete search history.

(56) References Cited

U.S. PATENT DOCUMENTS 3,940,100 A * 2/1976 Haug ..... A47B 3/00 248/165
5,853,313 A * 12/1998 Zheng ..... A63H 33/065 403/345
6,179,681 B1 * 1/2001 Matos ..... A63H 33/084 446/101
8,109,803 B2 * 2/2012 Kichijo ..... A63H 33/108 428/33
D754,261 S * 4/2016 Nelson ..... D21/489

FOREIGN PATENT DOCUMENTS

GB 2 054 393 * 2/1981 ..... A63H 33/08

* cited by examiner

*Primary Examiner* — Michael P Ferguson
(74) *Attorney, Agent, or Firm* — Kirby B. Drake; Klemchuk LLP

(57) ABSTRACT

Systems and methods are provided for connecting flat sheets formed from a variety of different materials to construct three-dimensional self-supporting structures having predetermined shapes and decorative and/or functional purposes. The flat sheets, which also may be referred to as individual components, may each include a plurality of prong sets and a plurality of slits whereby a prong set from an individual component may be inserted into a slit of another individual component to interlock and form a joint between the individual components. Each individual component may form one or more joints with the other individual components. The tension created in the joints may provide depth to the surface, which in turn may create structure.

15 Claims, 10 Drawing Sheets

SYSTEMS AND METHODS FOR FORMING SELF-SUPPORTING THREE-DIMENSIONAL STRUCTURES

FIELD OF THE DISCLOSURE

The present disclosure generally relates to self-supporting structures, and more particularly to systems and methods of connecting flat sheets formed from a variety of different materials to construct three-dimensional structures with predetermined shapes and purposes.

BACKGROUND

In the past, structures, such as lamp shades and room dividers, have been limited in how pieces may be connected together to form such structures. Further, there have been limitations in the size of these structures for storage and transport as well as how a user may put together such structures and have them be self-supporting.

SUMMARY

Embodiments of the present disclosure may provide a system for constructing a self-supporting three-dimensional structure, the system comprising a plurality of individual components, each of the plurality of individual components having a plurality of prong sets and a plurality of slits, wherein a prong set from one of the plurality of individual components may be inserted into a slit from another of the plurality of individual components to interlock and form a joint between the individual components, and wherein a plurality of joints may be formed in a repeating pattern to create the self-supporting three-dimensional structure. Each of the plurality of prong sets may comprise a combination of two equally sized prongs having a prong slit disposed between the two equally sized prongs extending to a point where the adjacent slits are disposed. Each of the prongs may be curved at the outer edge relative to the center point of the individual component. Each of the plurality of individual components may include three prong sets and three slits. Each of the plurality of slits may be formed in an extended ovular shape. Each of the plurality of slits may be disposed parallel to a side of the individual component and positioned so as to not abut any prong slits forming part of the individual component. When the prong set is inserted into the slit, a positive surface and a negative surface may be formed such that the prongs of the prong set may be exposed on the negative surface. Each of the plurality of individual components may be formed of a material selected from the group comprising paper, plastic, fabric, thin sheet metal, wood, and palm leaves. The material forming each of the plurality of individual components may be fire retardant. The interior of the self-supporting three-dimensional structure may be hollow and may further comprise a lighting mechanism disposed within the interior of the structure.

Embodiments of the present disclosure may provide a kit for constructing a self-supporting three-dimensional structure, the kit comprising a plurality of individual components, each of the plurality of individual components comprising a plurality of slits, each of the slits disposed parallel to a side of the individual component and a plurality of prong sets, each of the prong sets comprising two equally sized prongs having a prong slit disposed between the two equally sized prongs extending to but not abutting the position where the adjacent slits are disposed, wherein the number of slits is equal to the number of prong sets on each of the plurality of individual components, and wherein when a prong set from one of the plurality of individual components is inserted into a slit from another of the plurality of individual components, the plurality of individual components interlock and form a joint between the individual components, and wherein when a plurality of joints are formed in a repeating pattern, the self-supporting three-dimensional structure may be formed. Each of the plurality of individual components may be formed of a non-rigid flat sheet of material. The material may be selected from the group comprising paper, plastic, fabric, thin sheet metal, wood, and palm leaves. The interior of the self-supporting three-dimensional structure formed using the kit may be hollow and may receive a lighting mechanism within the interior of the structure. The self-supporting three-dimensional structure may have a shape selected from the group comprising conical, double conical, cylindrical, square, circular, rectangular, free form and irregular shape or structure. It also should be appreciated that one or more shapes may be fused or otherwise bound together to form a solid structure or object. It may be further appreciated that one or more shapes may be used to form a shin or act as a mold without departing from the present disclosure. The self-supporting three-dimensional structure may be a room divider, a skin, a covering, a garment, an accessory (including but not limited to a handbag or a rucksack), seating, a table, a receptacle, a container, an awning, a parasol-type skin, a parasol-type structure, a shelter, a tent, and a permanent structure without departing from the present disclosure. The self-supporting three-dimensional structure may be selectively assembled and disassembled.

Embodiments of the present disclosure may provide a method for forming a self-supporting three-dimensional structure, the method comprising providing a plurality of individual components, each of the plurality of individual components having a plurality of prong sets and a plurality of slits; inserting a prong set from one of the plurality of individual components into a slit from another of the plurality of individual components to form a joint between the individual components; and forming a plurality of joints in a repeating pattern to form the self-supporting three-dimensional structure.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide systems and methods of connecting flat sheets formed from a variety of different materials to construct three-dimensional self-supporting structures having predetermined shapes and decorative and/or functional purposes. The flat sheets, which also may be referred to herein as individual components, may each include a plurality of prong sets and a plurality of slits whereby a prong set from an individual component may be inserted into a slit of another individual component to interlock and form a joint between the individual components. Each individual component may form one or more joints with the other individual components. The tension created in the joints may provide depth to the surface, which in turn may create structure.

Figure 1:
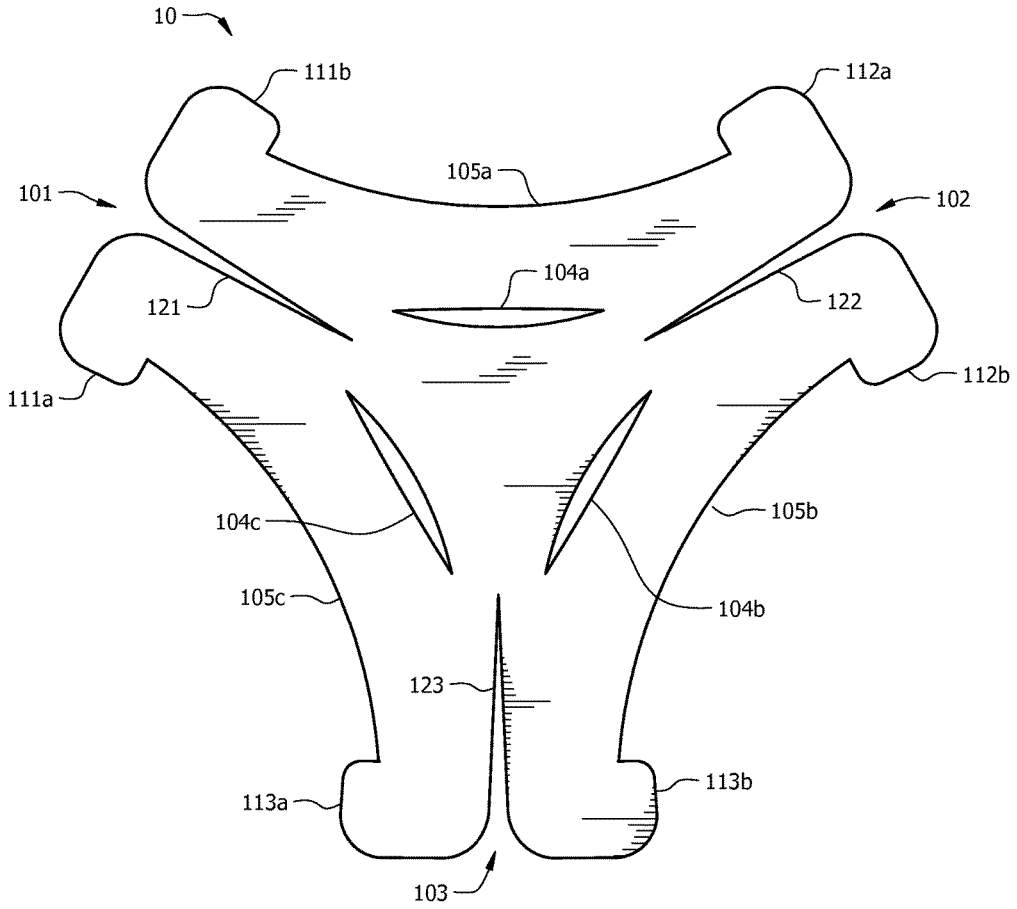
FIG. 1 depicts an individual component used to form a self-supporting structure according to an embodiment of the present disclosure.

FIG. 1 depicts individual component 10 according to an embodiment of the present disclosure. Individual component 10 may include prong sets 101, 102, 103 disposed in a triangular shape and positioned equidistant from one another. However, while the prong sets are depicted as equidistant from one another in FIG. 1, it should be appreciated that there may be some variation in the spacing depending on the type of shape that the structure takes without departing from the present disclosure. A prong set may be formed as a combination of two equally sized prongs having a prong slit disposed between the two equally sized prongs extending to a point where the slits within the individual components are disposed. Prong set 101 may be formed from prongs 111*a*, 111*b* of equal size and prong slit 121 disposed between prongs 111*a*, 111*b*. Prong set 102 may be formed from prongs 112*a*, 112*b* of equal size and prong slit 122 disposed between prongs 112*a*, 112*b*. Similarly, prong set 103 may be formed from prongs 113*a*, 113*b* of equal size and prong slit 123 disposed between prongs 113*a*, 113*b*. The shape of the prongs may provide for maximum adjustability so that when a prong set is inserted into a slit (as will be described further below), the prongs may slide into the slit as far down as possible to form a secure connection between the prong set and the slit.

The prongs forming each of the prong sets are curved at their outer edge relative to the center point of individual component 10 such that they may more securely interlock within the slit. However, it should be appreciated that the prongs may be formed in other shapes without departing from the present disclosure. For example, the prongs may be formed in an L-shape, and these prongs may be movable yet stable when inserted into a slit. The prongs may also be formed in a Z-shape that may allow the prongs to move easily into a slit and may be solidly formed. The angles of the individual prongs also may affect the flexibility of the prongs when they are inserted into a slit.

Further, while only three prong sets are depicted in FIG. 1, it should be appreciated that fewer or more than three prong sets may form part of an individual component without departing from the present disclosure.

Slits 104*a*, 104*b*, 104*c* may be of equal length and width and may be disposed along sides 105*a, b, c* respectively of the triangular shape of individual component 10. However, while the slits are depicted as equidistant from one another in FIG. 1, it should be appreciated that there may be some variation in the spacing depending on the type of shape that the structure takes without departing from the present disclosure. It should be appreciated that the size of the slit may affect the flexibility of the individual component when it is interlocked with another individual component to form a structure. In an embodiment of the present disclosure, each of slits 104*a*, 104*b*, 104*c* may be formed in a half-moon, an extended ovular shape, or another similar shape as depicted in FIG. 1 to allow a sufficient opening for one or more prong sets to be inserted within the slit.

Slits 104*a, b, c* may be formed approximately 1 cm away from an outer edge of sides 105*a, b, c* of individual component 10 respectively. Slits 104*a, b, c* may each extend approximately 3 cm in length. These dimensions are for an individual component having a length from the midpoint of one side (105*a*) to a midpoint of another side (105*b*) across individual component 10 of approximately 5 cm. Accordingly, it should be appreciated that as the size of the individual component or the size of the resultant structure to be formed increases or decreases, the spacing and the size of the slit may similarly increase or decrease.

Figure 7:
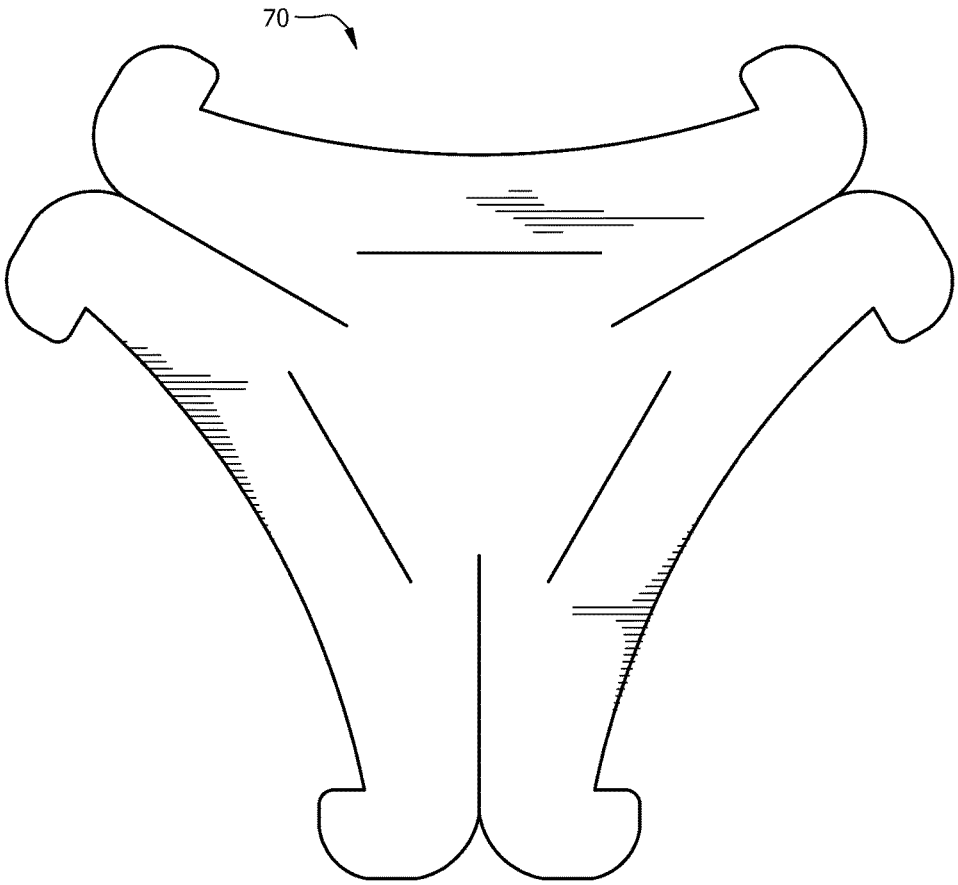
FIG. 7 depicts an individual component used to form a self-supporting structure according to an embodiment of the present disclosure.

Regardless the dimensions of each slit, it should be appreciated that slit 104*a* may be positioned so that the end points of slit 104*a* may not touch prong slit 121 or prong slit 122 insofar as having an end point of slit 104*a* touch prong slit 121 or prong slit 122 may weaken the interlocking function or, particularly if the individual component is formed from paper, having the slits abut one another may cause the paper to split apart. Similarly slits 104*b*, 104*c* should be formed in a manner so as to not touch any of the prong slits according to embodiments of the present disclosure. It should be appreciated that as the number of prong sets increases, the number of slits may be increased without departing from the present disclosure. FIG. 7 depicts an individual component according to another embodiment of the present disclosure with slits that are different from slits 104*a*, 104*b*, 104*c*.

The prong set and slit system may result in a semi-permeable and rigid surface for a self-supporting structure constructed according to embodiments of the present disclosure. More specifically, this prong and slit construction may result in a positive surface and a negative surface. The positive surface may be provided as a clean, flat skin, and the negative surface may be more dimpled in structure whereby the prongs that have been inserted through a slit may be exposed. As the negative surface may provide the interior of the resultant self-supporting structure (i.e., may be hidden from view and may not affect the visibility of light if used within the structure), the prongs may remain exposed on this negative surface (as depicted, for example, in FIGS. 2B and 3B).

Figure 2A:
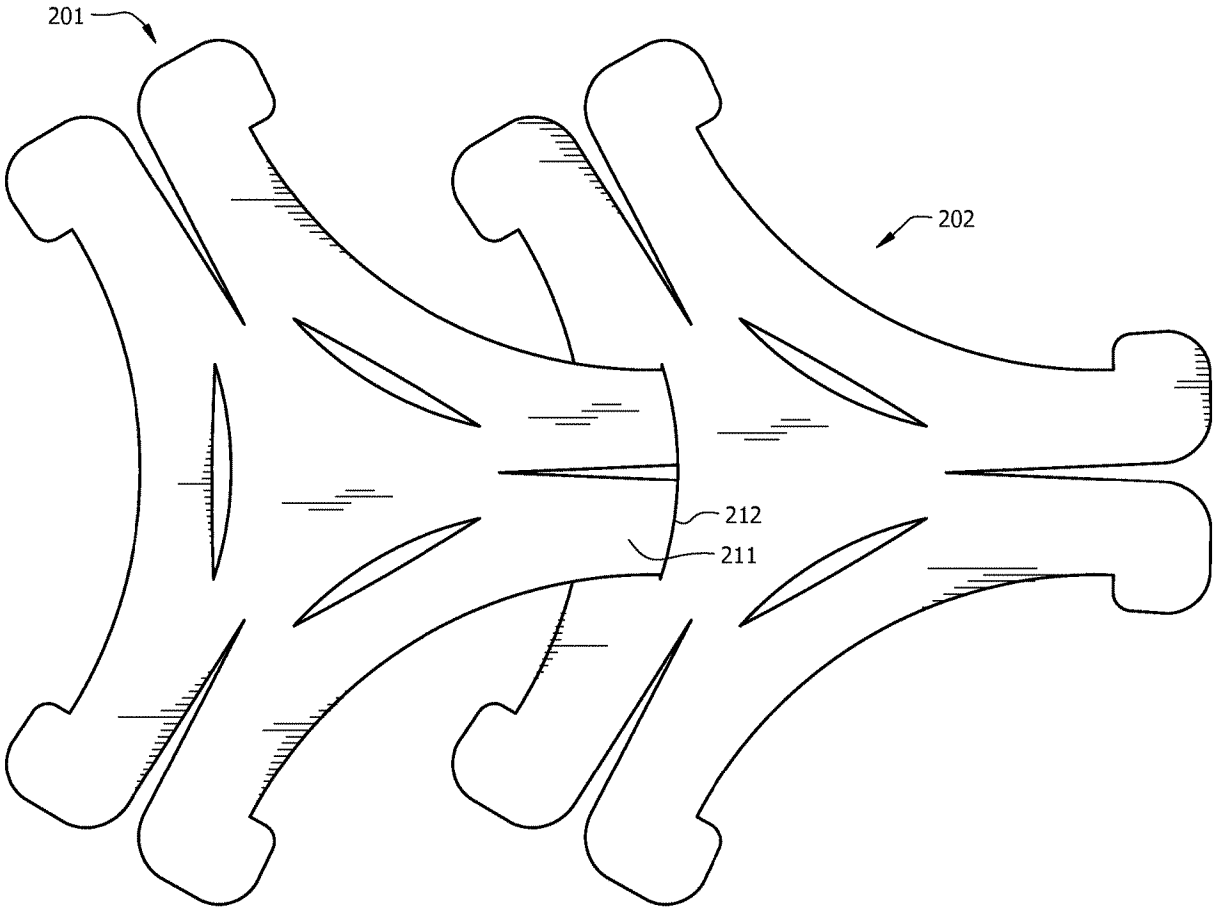
FIG. 2A depicts a front view of the interlocking of a first individual component with a second individual component to form a self-supporting structure according to an embodiment of the present disclosure.

FIG. 2A depicts a front view of the interlocking of first individual component 201 with second individual component 202 according to an embodiment of the present disclosure. Prong set 211 of first individual component 201 may be inserted into slit 212 of second individual component 202. Prong set 211 may compress within slit 212 to interlock first individual component 201 with second individual component 202.

Figure 2B:
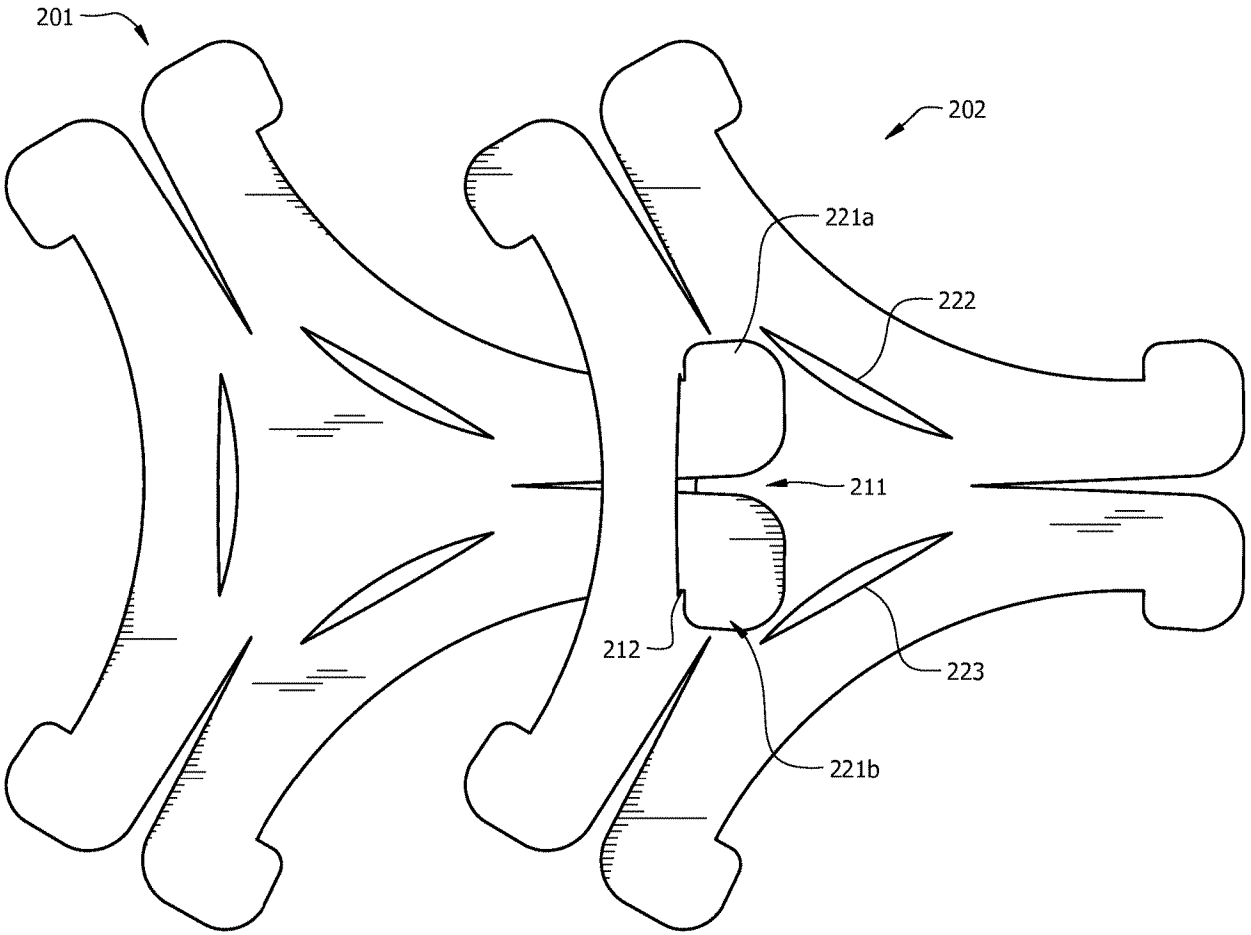
FIG. 2B depicts a back view of the interlocking of a first individual component with a second individual component to form a self-supporting structure according to an embodiment of the present disclosure.

FIG. 2B depicts the back view of the interlocking of first individual component 201 with second individual component 202 through the prong set and slit mechanism previously described. In this embodiment of the present disclosure, the prongs of prong set 211 are exposed. When prong set 211 is inserted into slit 212, it should be appreciated that prongs 221*a, b* of prong set 211 do not otherwise obscure slit 222 or slit 223, thereby allowing additional prong sets to be inserted through slit 222 and/or slit 223 to form further joints between individual components to continue to construct a self-supporting structure according to embodiments of the present disclosure.

Figure 3A:
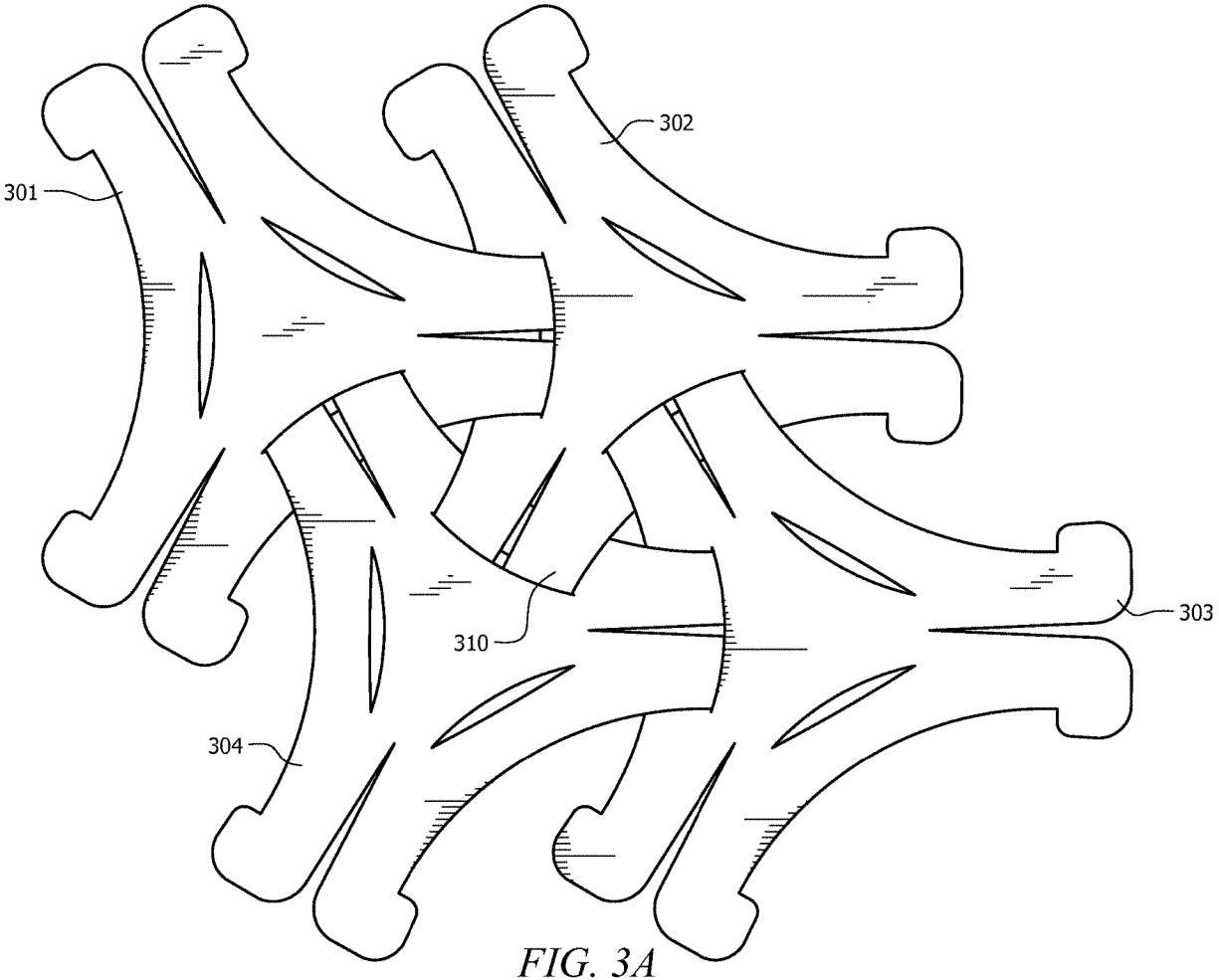
FIG. 3A depicts a front view of the interlocking of a plurality of individual components to form a self-supporting structure according to an embodiment of the present disclosure.

FIG. 3A depicts a front view of the interlocking of a plurality of individual components 301, 302, 303, 304 to form part of a self-supporting structure according to an embodiment of the present disclosure. In this embodiment, four individual components 301, 302, 303, 304 are depicted as being interlocked each through insertion of a prong set of one individual component through a slit of another individual component. Each of the slits and each of the prong sets have a similar shape, dimensions, and proportionality regardless of the individual component. As such, different slits of an individual component may receive different prong sets of another individual component depending on the type or shape of self-supporting structure that may be formed. When the plurality of individual components have been interlocked with one another, it should be appreciated that some contouring (as depicted by contour 310) within the central portion where the individual components have been interlocked may occur. This may provide for curvature in the formation of a self-supporting structure, for example, if a cylindrical or conical design may be formed.

Figure 3B:
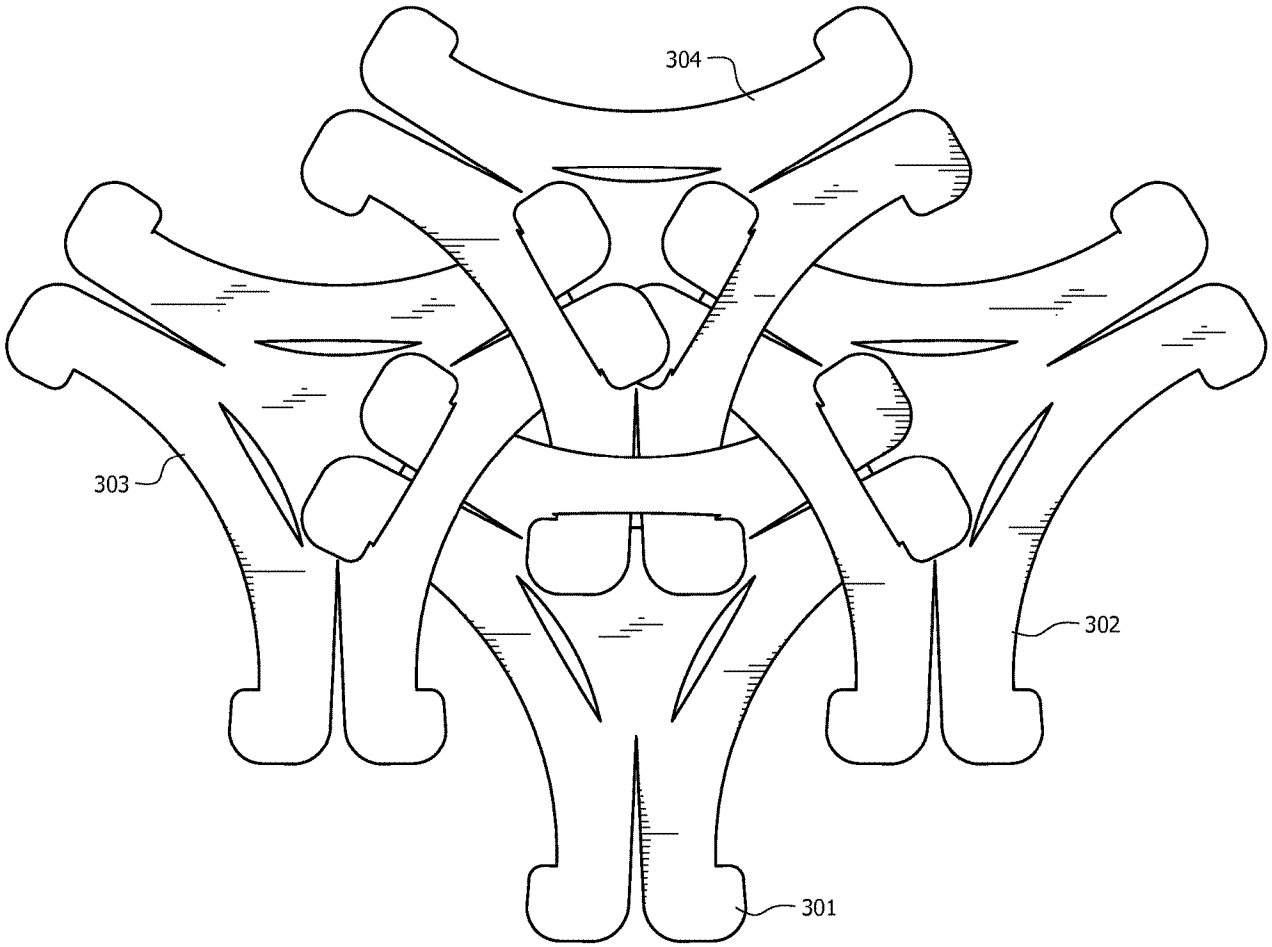
FIG. 3B depicts a back view of the interlocking of a plurality of individual components to form a self-supporting structure according to an embodiment of the present disclosure.
Figure 8:
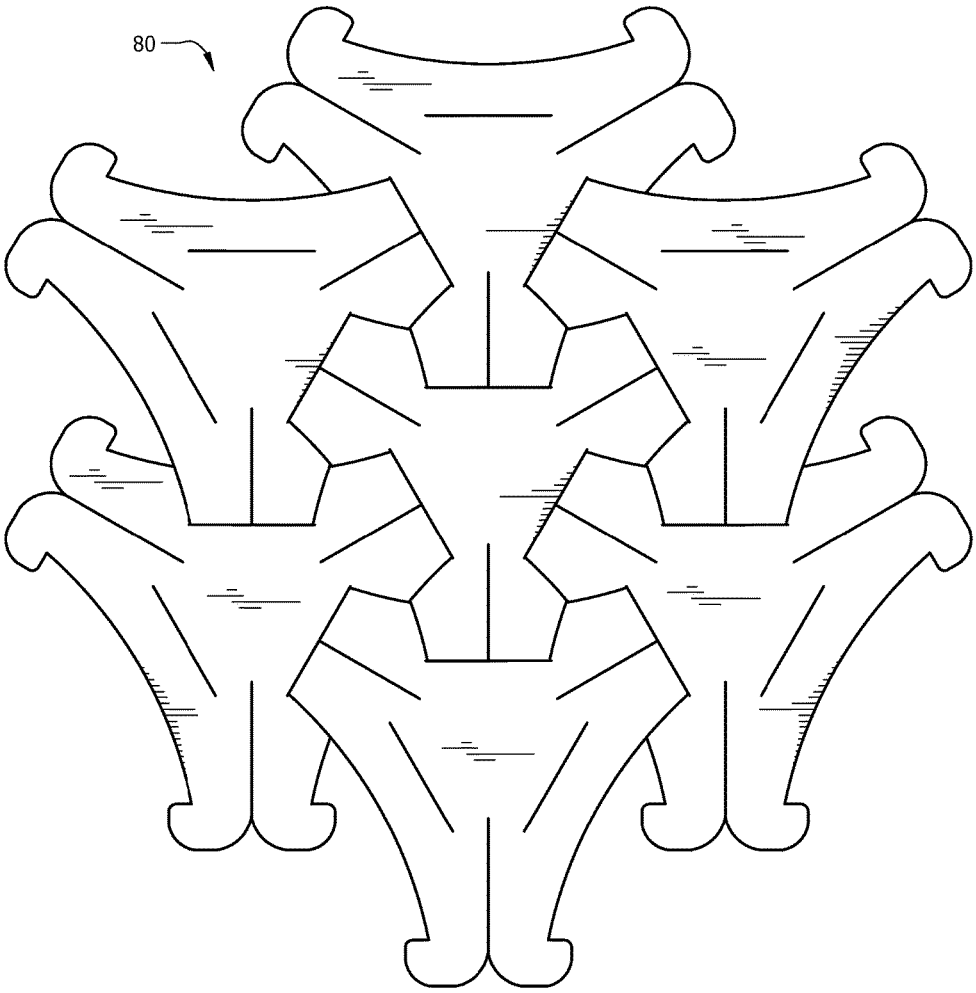
FIG. 8 depicts interlocking of individual components used to form a self-supporting structure according to another embodiment of the present disclosure.

FIG. 3B depicts a back view of the interlocking of a plurality of individual components 301, 302, 303, 304 to form part of a self-supporting structure according to an embodiment of the present disclosure. Similar to FIG. 2B, in this embodiment of the present disclosure, the prongs of each prong set of an individual component that has been inserted through a slit of another individual component are exposed. Even when a plurality of prong sets have been inserted into different slits, it should be appreciated that the prongs of each prong set inserted through a slit do not otherwise obscure the other slits, thereby allowing additional prong sets to be inserted through other slits to further construct the self-supporting structure. FIG. 8 depicts interlocking of individual components used to form a self-supporting structure according to another embodiment of the present disclosure.

Figure 4:
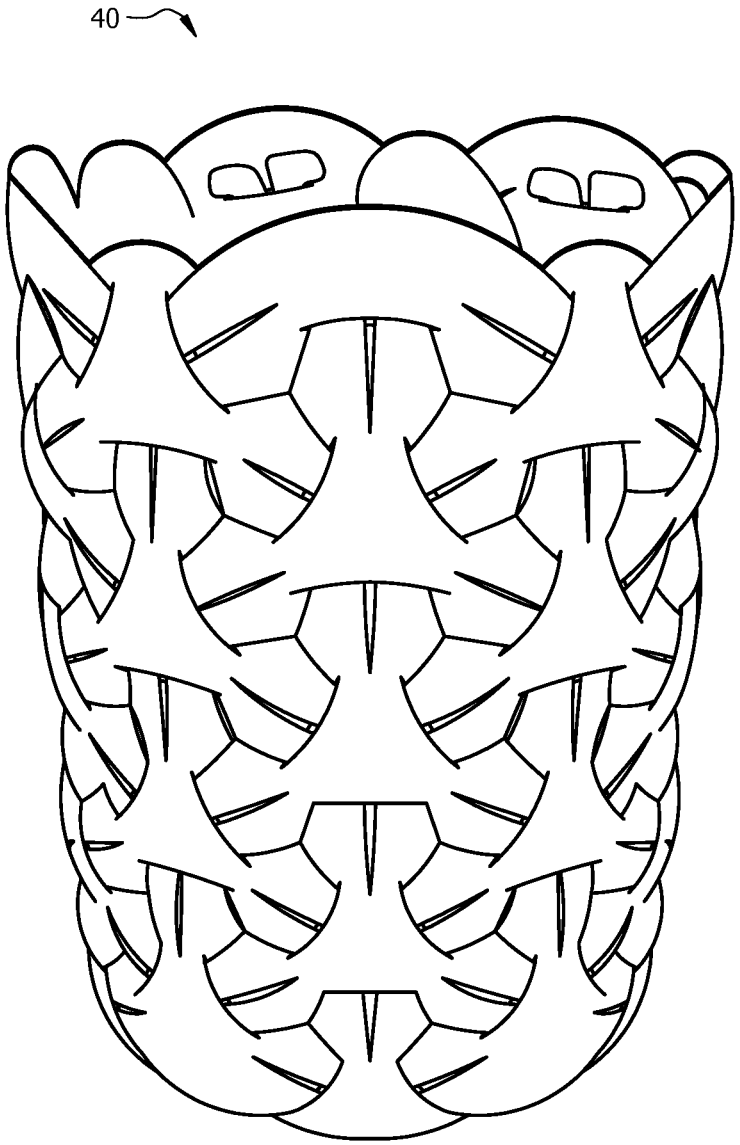
FIG. 4 depicts a self-supporting structure according to an embodiment of the present disclosure.

FIG. 4 depicts self-supporting structure 40 according to an embodiment of the present disclosure constructed by forming a series of joints by connecting prong sets from certain individual components with slits of other individual components. It should be appreciated that when a prong set of an individual component is inserted through a slit of another individual component, this is not necessarily a permanent connection. While the prong set is inserted through the slit to form an interlocking joint between individual components of a self-supporting structure, the resultant self-supporting structure may remain rigid and able to stand without support even without the use of an adhesive or other fastening mechanism. Further, the lack of a permanent connection may provide means for the self-supporting structure to be assembled and disassembled depending on the needs, for example, of a manufacturer, seller, and/or end user.

Self-supporting structure 40 is formed in a cylindrical pattern wherein structure 40 may be placed on the floor or on a table in a room. In this embodiment of the present disclosure, structure 40 has a hollow interior wherein a lighting mechanism may be disposed within structure 40. When the lighting mechanism is turned on, light may shine through the top portion of structure 40 as well as through the slits within the pattern of structure 40. In some embodiments of the present disclosure, light also may stream from the bottom portion of structure 40.

In embodiments of the present disclosure, a lighting mechanism employed within a self-supporting structure may operate through power supplied from a wall outlet. However, it should be appreciated that there may be embodiments wherein the lighting mechanism may be battery-powered or cordless without departing from the present disclosure. The lighting mechanism may include, but is not limited to, a fluorescent lamp, a compact fluorescent lamp, a halogen lamp, a neon lamp, and a light emitting diode (LED). It should be appreciated that more than one lighting mechanism may be disposed within a self-supporting structure without departing from the present disclosure. It also should be appreciated that there may be embodiments wherein more than one type of lighting mechanism may be employed. It may further be appreciated that the lighting mechanism may be disposed so that it is placed on the floor or on the table on which the self-supporting structure is placed so that the lighting mechanism may be placed within the hollow region of the structure. However, there may be other embodiments of the present disclosure wherein the lighting mechanism may be placed on a stand or other similar structure within the hollow portion of the self-supporting structure. In some embodiments of the present disclosure, the lighting mechanism may be placed behind the self-supporting structure. Regardless what lighting mechanism may be employed or where the lighting mechanism is disposed, it should be appreciated that the self-supporting structure should be formed of a heat-resistant material such that the lighting mechanism may be turned on and used for a prolonged period of time without resulting in damage to the self-supporting structure.

Figure 5:
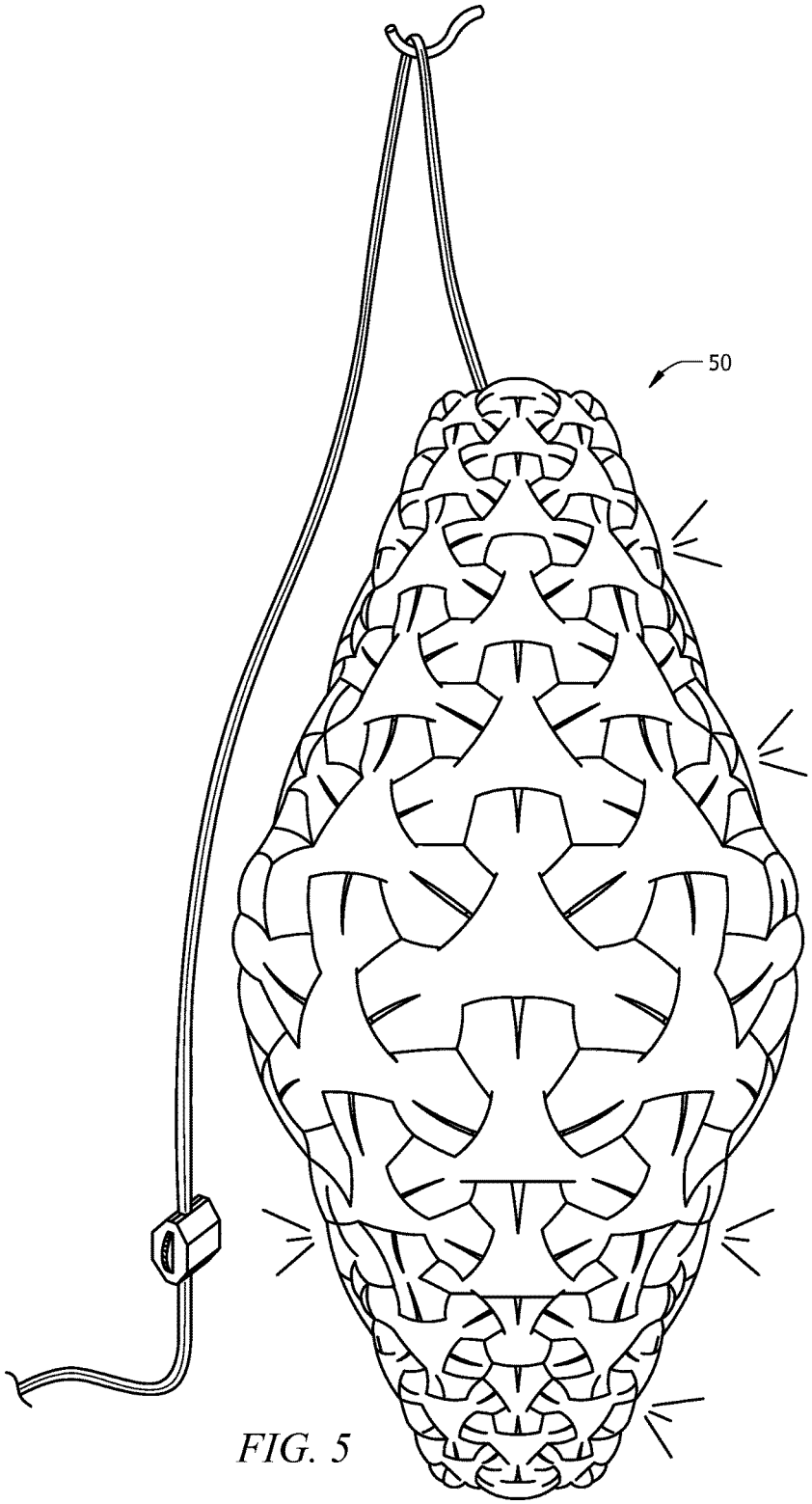
FIG. 5 depicts another self-supporting structure according to an embodiment of the present disclosure.

FIG. 5 depicts self-supporting structure 50 according to an embodiment of the present disclosure. In this embodiment, structure 50 is formed in a double conical pattern and includes fastening mechanism 501 such that it may be hung, for example, from a ceiling, a rafter/beam, a hook or another elevated support structure. It should be appreciated that fastening mechanism 501 may be removable or may be permanently affixed to structure 50 without departing from the present disclosure. Fastening mechanism 501 may be formed of the same material as structure 50 or it may be formed from a different material without departing from the present disclosure. However, it should be appreciated that fastening mechanism 501 should be of a sufficiently light weight so that it will not cause structure 50 to alter or lose its shape when hanging.

In this embodiment of the present disclosure, as structure 50 may be hung using fastening mechanism 501, it should be appreciated that the lighting mechanism that may be disposed within structure 50 should be configured in a manner that it does not need to be supported by a table or the floor. For example, a cord associated with the lighting mechanism may be threaded through the open top of structure 50 to provide light within structure 50. In an embodiment of the present disclosure, if fastening mechanism 501 is attached to a hook, the cord of the lighting mechanism also may be looped over the same hook and threaded into the interior of structure 50. However, there may be other embodiments of the present disclosure wherein the cord may not be connected or associated with the same fastening point as structure 50. For example, the lighting mechanism may be affixed to the ceiling and may be adjustable to be selectively disposed within structure 50. In further embodiments of the present disclosure, the lighting mechanism may be cordless and may be selectively attachable to the interior of structure 50 either directly or indirectly.

Figure 6:
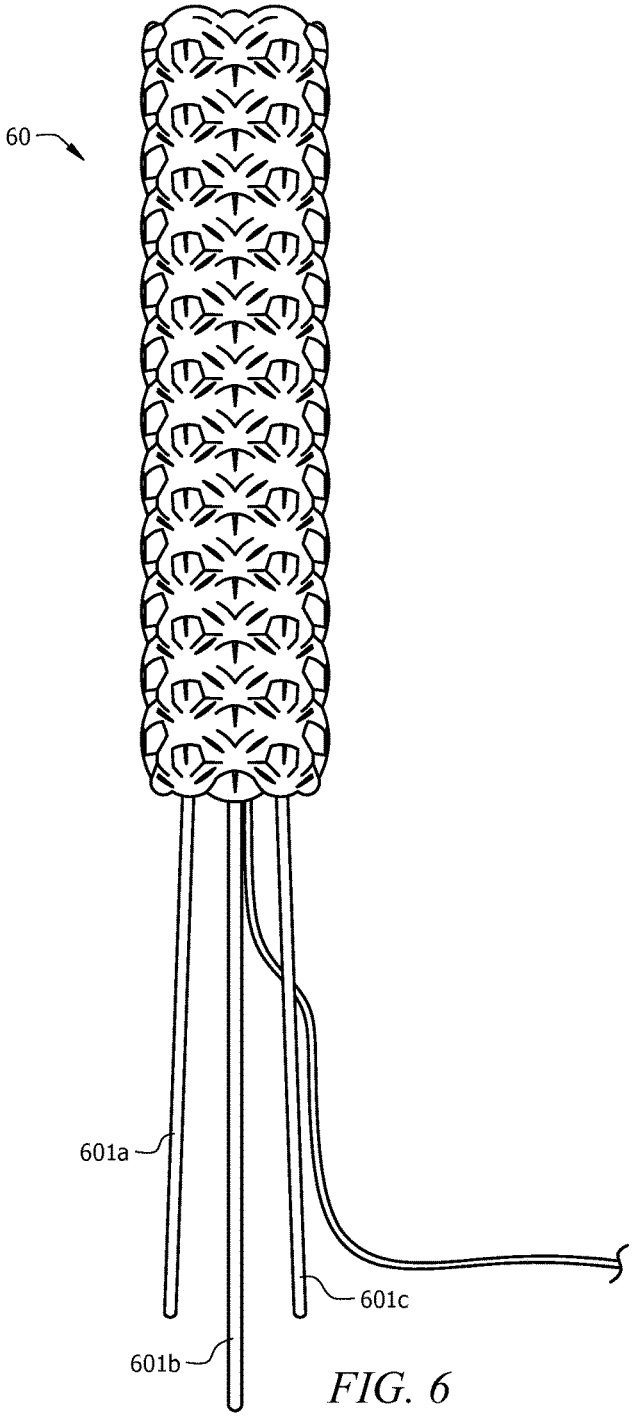
FIG. 6 depicts another self-supporting structure according to an embodiment of the present disclosure.

FIG. 6 depicts self-supporting structure 60 according to another embodiment of the present disclosure. Structure 60 has been formed in a cylindrical design; however, it should be appreciated that the structure may be formed in other shapes without departing from the present disclosure. While there may be embodiments wherein the structure may be completely self-supporting such that it may be placed on a table or the floor and not require any additional mechanism to keep it stable, in this embodiment, legs 601*a, b, c* may be affixed to the bottom portion of structure 60. It should be appreciated that the attachment between structure 60 and legs 601*a, b, c* may be permanent or it may be selectively removable without departing from the present disclosure. It also should be appreciated that legs 601*a, b, c* may be affixed to a platform on which structure 60 is placed according to embodiments of the present disclosure, and the attachment between legs 601*a, b, c* and the platform may be permanent or selectively removable. Legs 601*a, b, c* may be attached to structure 60, for example, to provide elevation or additional height for structure 60.

In this embodiment, a lighting mechanism may be deployed within the interior of structure 60 so that light may shine through the slits of structure 60 or through the top portion of structure 60. As previously described, the lighting mechanism may be powered through a wall outlet or may be cordless and/or battery-powered without departing from the present disclosure. It also should be appreciated that the lighting mechanism may be threaded through the top portion or the bottom portion of structure 60 according to embodiment of the present disclosure. In other embodiments of the present disclosure, the lighting mechanism may be cordless or battery-powered such that it may be removably attached to the interior of structure 60 or placed on the platform on which structure 60 sits.

Embodiments of the present disclosure may provide a self-supporting structure formed using compact and non-rigid flat sheets of material without the use of additional support materials. The structure may be composed of various materials. In one embodiment of the present disclosure, the structure may be formed from paper. For durability, the paper may have a "slick" exterior finish to as to be water-repellent. This finish may be of a plastic, wax or other water-resistant composition. Regardless what finish may be employed, it should be appreciated that the finish should be formed using a material that may be a fire retardant insofar as the structure may be placed within the interior of a room, such as in a house or business. A range of different weights of paper may be used to form the structure including industrial, high-weight paperboard to a lighter weight paper that may still be rigid enough to stand upright. By constructing the structure from paper, the structure may be able to flex somewhat if subjected to wind, air conditioning, or other movement but will be less likely to topple over than if constructed from a substantially rigid material. Also, when erected, the structure may be substantially hollow so that air may flow through the hollow interior of the structure. Further, the hollow nature of the structure may allow for a lighting mechanism to be inserted within the structure so that the structure may be employed as a light within a room. Other materials that may form structures according to embodiments of the present disclosure may include, but are not limited to, plastic, fabric, thin sheet metal, wood, and palm leaves. Regardless what material may be used to form a self-supporting structure, it should be appreciated that these materials should be water-repellent and/or water resistant and should also have fire retardant properties.

It should be appreciated that the individual components forming a self-supporting structure also may be multi-layered without departing from the present disclosure. In an embodiment of the present disclosure, the paper material forming each individual component may be composed of multi-layered paper or may be formed in a sandwich construction wherein an interior layer may be composed of a thin fabric, plastic, or even a metallic or foil material, in order to increase the structural integrity of the structure according to embodiments of the present disclosure. It also should be appreciated that different materials may be used to form individual components without departing from the present disclosure.

It should be appreciated that the individual components forming the structure may have a variety of colors and textures. The individual components also may include reflecting properties so that the structure may be more visible in low light or at night. In some embodiments of the present disclosure, the individual components may be painted or may be printed with different colors or patterns.

It should be appreciated that a self-supporting structure formed according to embodiments of the present disclosure may be constructed in a variety of sizes and dimensions (width and/or height) depending on how the structure is to be used. However, it should be appreciated that the height may be limited insofar as to not adversely affect the stability of the structure as well as to address height restrictions related to the size of room.

Embodiments of the present disclosure may provide a self-supporting structure that may be constructed in a variety of different patterns. In embodiments of the present disclosure, the self-supporting structure may be constructed in patterns including but not limited to a cylindrical pattern, a square or rectangular pattern, a circular pattern, and a conical or double conical pattern. Other non-polygon shapes may be formed without departing from the present disclosure. It should be appreciated that prong and slit system employed to form a self-supporting structure according to embodiments of the present disclosure is not dependent on a specific template but may be applied to constructing self-supporting structures having a range of shapes and styles. The shapes in any given structure can be identical or vary in size and/or shape to control the form.

Systems formed according to embodiments of the present disclosure may be applicable in a range of areas for any solution that may have space limitations for storage, display and/or transport. Embodiments of the present disclosure may condense in size, which may solve problems related to storage, shipping and material use. For example, if the structure is to be sold in a store, the structure may be deconstructed and sold as a kit wherein the individual components are stacked in an unconstructed state. Accordingly, the structure may be sold in a relatively small box or other minimal packaging, thereby taking up a minimal amount of space on the floor of the store, in the warehouse, or on a delivery/shipping truck before they are later constructed into a self-supporting structure according to embodiments of the present disclosure. Further, a customer may selectively construct or deconstruct the structure, thereby making it easier when moving or when additional space may be needed within a room. However, it should be appreciated that the structure also may be sold or otherwise provided in a pre-constructed state without departing from the present disclosure.

It should be appreciated that the self-supporting structure may be placed on the floor, on a table, set on a platform, or hung from a ceiling or other elevated structure as have been previously described according to embodiments of the present disclosure. However, there may be other embodiments wherein a self-supporting structure may be placed on a stand or a support having permanent or removable legs to further stabilize and/or elevate the structure without departing from the present disclosure.

A fully constructed self-supporting structure may be constructed so that it may stand on its own according to embodiments of the present disclosure. However, it should be appreciated that a completed structure may stand co-dependently with another structure or object according to embodiments of the present disclosure. In some embodiments of the present disclosure, one or more of the completed structures may be lined up or otherwise attached to form a room divider. It should be appreciated that the more than one completed structure may be placed side-by-side without a fastener; however, in some embodiments of the present disclosure, more than one completed structure may be fastened to each other using an adhesive or other similar type fastener without departing from the present disclosure. While certain resultant structures have been described herein, it should be appreciated that the structures formed according to embodiments of the present disclosure are not limited to these structures. For example, the structure formed may be a shelter, a tent or another type of permanent structure without departing from the present disclosure.

As previously described, embodiments of the present disclosure may provide a self-supporting structure including a lighting function wherein once the self-supporting structure is formed, a lighting mechanism may be disposed within the completed structure so that the light may stream through the slits of the structure as well as, the top and/or bottom of the structure depending on its placement within a room. In other embodiments of the present disclosure, a lighting mechanism may be placed behind the self-supporting structure to provide light without being disposed within the structure itself. The lighting mechanism may be a battery-powered light or it may be plugged into a wall. However, it should be appreciated that the self-supporting structure may be used without a lighting mechanism without departing from the present disclosure.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A system comprising:

a lighting mechanism comprising:

a self-supporting three-dimensional lamp covering structure, wherein a plurality of joints are formed in a repeating pattern;

a plurality of triangular-shaped individual components, each of the plurality of individual components having a plurality of prong sets and a plurality of slits, wherein each slit of the plurality of slits is arranged in a central triangular portion of each individual component of the plurality of individual components, wherein each of the plurality of prong sets comprise two equally sized prongs having a prong slit disposed at each vertex of the central triangular portion between the two equally sized prongs extending to a point where adjacent slits are disposed, wherein each of the plurality of slits is disposed substantially parallel to each side of the central triangular portion of the individual component and positioned adjacent to a pair of adjacent prong slits so as to not abut any prong slits forming part of the individual component, wherein a prong set from one of the plurality of individual components is inserted into a slit from another of the plurality of individual components to interlock and form a joint selected from the plurality of joints between the individual components; and a negative surface including prongs of the plurality of prong sets formed to provide a hollow interior of the self-supporting three-dimensional lamp covering structure without affecting visibility of light within or through the self-supporting three-dimensional lamp covering structure; and a lighting source disposed within the hollow interior of the lamp covering structure.

2. The system of claim 1 wherein each of the prongs is curved at the outer edge relative to the center point of the individual component.

3. The system of claim 1 wherein each of the plurality of individual components includes three prong sets and three slits, and wherein the three slits are provided in the central triangular portion of each individual component of the plurality of individual components.

4. The system of claim 1 wherein each of the plurality of slits is formed in an extended ovular shape.

5. The system of claim 1 wherein when the prong set is inserted into the slit, a positive surface and the negative surface are formed such that the prongs of the prong set are exposed on the negative surface and remain exposed when the negative surface is formed to provide an interior of the self-supporting three-dimensional lamp covering structure, wherein the positive surface is flat in structure and the negative surface is dimpled in structure, and wherein the positive surface is provided on a side of the structure opposite the negative surface.

6. The system of claim 1 wherein each of the plurality of individual components is comprised of paper.

7. The system of claim 1 wherein each of the plurality of individual components is formed of a material selected from the group comprising:

paper, plastic, fabric, thin sheet metal, wood, and palm leaves.

8. The system of claim 1 wherein the material forming each of the plurality of individual components is fire retardant.

9. A kit comprising: a lighting mechanism comprising:

a self-supporting three-dimensional lamp covering structure, wherein a plurality of joints are formed;

a plurality of triangular-shaped individual components, each of the plurality of individual components comprising:

a plurality of slits, wherein each slit of the plurality of slits is arranged in a central triangular portion of each individual component of the plurality of individual components and is disposed substantially parallel to each side of the central triangular portion of each individual component; and a plurality of prong sets, each of the prong sets comprising two similarly sized prongs having a prong slit disposed at each vertex of the central triangular portion between the two similarly sized prongs extending to but not abutting the position where adjacent slits are disposed, wherein each slit of the plurality of slits is positioned adjacent to a pair of adjacent prong slits, wherein the number of slits is equal to the number of prong sets on each of the plurality of individual components, and wherein when a prong set from one of the plurality of individual components is inserted into a slit from another of the plurality of individual components, the plurality of individual components interlock and form a joint selected from the plurality of joints between the individual components; and a negative surface including prongs of the plurality of prong sets formed to provide a hollow interior of the self-supporting three-dimensional lamp covering structure without affecting visibility of light within or through the self-supporting three-dimensional lamp covering structure; and a lighting source within the hollow interior of the lamp covering structure.

10. The kit of claim 9 wherein each of the plurality of individual components is formed of a non-rigid flat sheet of material.

11. The kit of claim 10 wherein the material is selected from the group comprising:

paper, plastic, fabric, thin sheet metal, wood, and palm leaves.

12. The kit of claim 9 further comprising:

a lighting mechanism within the interior of the structure, wherein the interior is hollow.

13. The kit of claim 9 wherein the self-supporting three-dimensional lamp covering structure has a shape selected from the group comprising:

conical, double conical, cylindrical, square, circular, and rectangular, free form, and irregular shape/structure.

14. The kit of claim 9 wherein the self-supporting three-dimensional lamp covering structure is selectively assembled and disassembled.

15. A method for forming a self-supporting three-dimensional lamp covering structure, the method comprising:

providing a plurality of triangular-shaped individual components, each of the plurality of individual components having a plurality of prong sets and a plurality of slits, wherein each slit of the plurality of slits is arranged in a central triangular portion of each individual component of the plurality of individual components and is disposed substantially parallel to each side of the central triangular portion of the individual component;

wherein each of the prong sets comprise two similarly sized prongs having a prong slit disposed at each vertex of the central triangular portion between the two similarly sized prongs extending to but not abutting the position where adjacent slits are disposed, wherein each slit of the plurality of slits is positioned adjacent to a pair of adjacent prong slits, inserting a prong set from one of the plurality of individual components into a slit from another of the plurality of individual components to form a joint between the individual components;

forming a plurality of joints in a repeating pattern to form a self-supporting three-dimensional lamp covering structure; and inserting a lighting source within a hollow interior of the self-supporting three-dimensional lamp covering structure.

* * * * *